United States Patent [19]

Thomas

[11] Patent Number: 5,000,071

[45] Date of Patent: Mar. 19, 1991

[54] GUITAR HOLDER

[76] Inventor: Keith E. Thomas, 5626 Riverhead Ave., Memphis, Tenn. 38135

[21] Appl. No.: 494,504

[22] Filed: Mar. 16, 1990

[51] Int. Cl.[5] ..... G10D 3/00; G10G 5/00

[52] U.S. Cl. ..... 84/327; 84/421; 224/910

[58] Field of Search ..... 84/327, 421; 224/910

[56] References Cited

U.S. PATENT DOCUMENTS

| | | | |
|---|---|---|---|
| 413,807 | 10/1889 | Loeser et al. | 224/910 X |
| 2,484,383 | 10/1949 | Lee | 224/910 X |
| 3,037,416 | 6/1962 | Cunningham | 84/327 |
| 3,366,293 | 1/1968 | Fyke | 84/327 X |
| 3,371,570 | 3/1968 | Lester | 84/327 |
| 4,310,111 | 1/1982 | Brent | 224/910 X |
| 4,343,217 | 8/1982 | Brody | 84/327 X |
| 4,715,259 | 12/1987 | Wittman | 84/327 |
| 4,742,751 | 5/1988 | Cherry | 84/327 |

*Primary Examiner*—Brian W. Brown

*Attorney, Agent, or Firm*—Walker & McKenzie

[57] ABSTRACT

An apparatus for securing a musical instrument to a waist belt that is attached relative to a performer's waist. The apparatus includes a first anchor for being attached to the waist belt; a second anchor for being attached to the musical instrument; and securing structure for removably securing the first anchor to the second anchor.

11 Claims, 3 Drawing Sheets

2
53
47
2
59
4
45
5
4
23
57
21
19
17
25
11
29
5

GUITAR HOLDER

BACKGROUND OF THE INVENTION

1. Field of the Invention

The present invention relates, in general, to a holder for allowing a musical instrument such as a guitar to be supported from a belt extending about a performer's waist.

2. Information Disclosure Statement

A preliminary patentability search conducted in class 84, subclasses 327 and 453, and class 224, subclasses 271 and 910 disclosed the following patents: Cunningham, U.S. Pat. No. 3,037,416 which discloses a flexible strap having a front end attached to the front of a median portion of a guitar body and having a rear end connected to a belt extending about a performer's waist; Fyke, U.S. Pat. No. 3,366,293 which discloses a strap for being looped about a performer's neck, passed downwardly around the back panel and side wall of a guitar body, and attached with a hook to the lower edge of a resonant hole in the front panel of the guitar body; Lester, U.S. Pat. No. 3,371,570 which discloses a plate for being attached to the back of a guitar body, the plate having at least one downwardly projecting hook for being hooked over a belt or the like extending about a performer's waist; Brent, U.S. Pat. No. 4,310,111 which discloses a support belt to be worn around a performer's waist, and a support plate to be attached to the back of a guitar or the like; Wittman, U.S. Pat. No. 4,715,259 which discloses a strap mounting assembly for an electric guitar that includes an electric pickup to permit rotation of the guitar body about a horizontal axis; and Cherry, U.S. Pat. No. 4,742,751 which discloses a tripod-type stand for supporting a guitar from the floor in a playing position so that a performer can play the guitar while the guitar is being supported by the stand. None of the above patents disclose or suggest the present invention. More specifically, none of the above patents disclose or suggest an apparatus including first anchor means for being attached to a waist belt extending around a performer's waist; second anchor means for being attached to a musical instrument; and securing means for removably securing the first anchor means to the second anchor means and thus securing the musical instrument to the waist belt.

SUMMARY OF THE INVENTION

The present invention is directed toward providing an improved apparatus for securing a musical instrument to a waist belt that is attached relative to a performer's waist.

The apparatus of the present invention includes first anchor means for being attached to a waist belt extending around a performer's waist; second anchor means for being attached to a musical instrument; and securing means for removably securing the first anchor means to the second anchor means.

One advantage of the apparatus of the present invention is that it allows guitars to be secured to a performer much faster and easier than the common shoulder strap type guitar holder.

Another advantage of the apparatus of the present invention is that it is less bulky than the common shoulder strap type guitar holder.

Another advantage of the apparatus of the present invention is that it allows a performer to quickly and easily change guitars or the like.

DESCRIPTION OF THE PREFERRED EMBODIMENT

Figure 8:
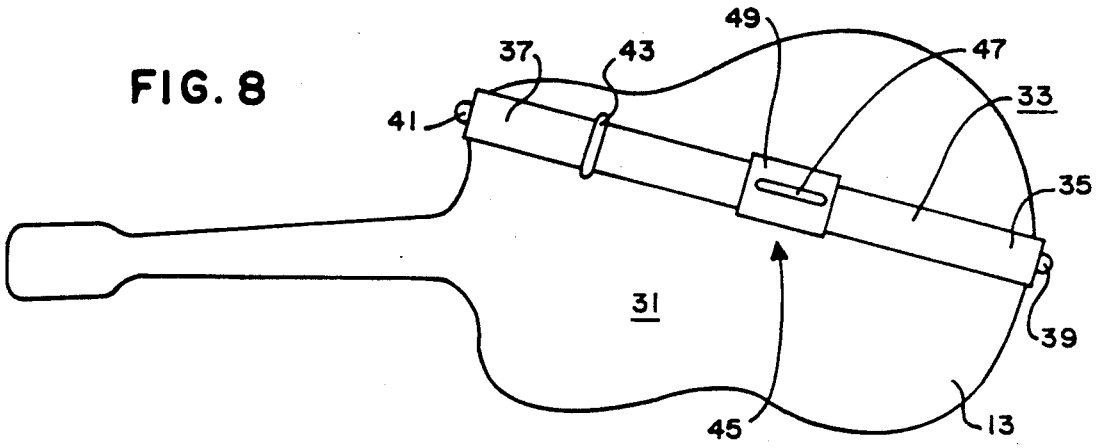
FIG. 8 is a rear elevational view of a guitar showing the second anchor means of the apparatus of the present invention attached to a guitar strap.
Figure 9:
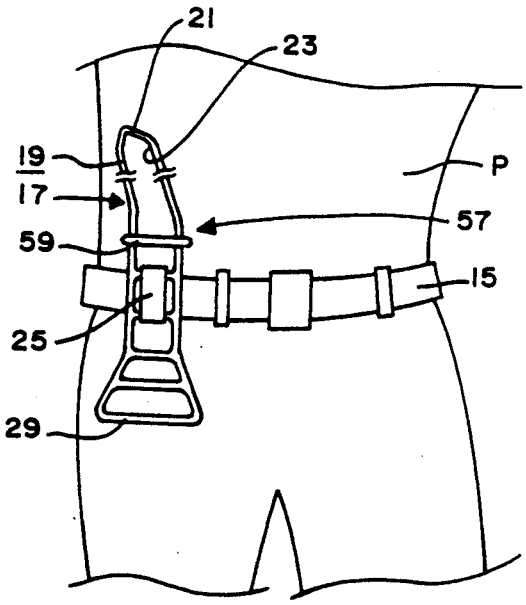
FIG. 9 is a front elevational view of the waist portion of a performer showing the first anchor means of the apparatus of the present invention attached to the performer's belt.
Figure 10:
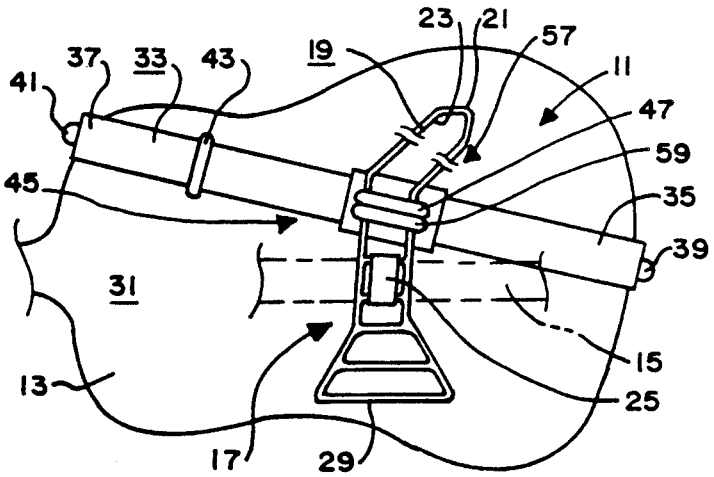
FIG. 10 is a somewhat diagrammatic view of the apparatus of the present invention with portions of a guitar, guitar strap, and performer's belt shown in broken lines.

The preferred embodiment of the apparatus 11 of the present invention is used to secure a musical instrument such as a guitar 13 to a waist belt 15 that is attached about the waist of a performer P (see, in general, FIGS. 8, 9 and 10).

Figure 5:
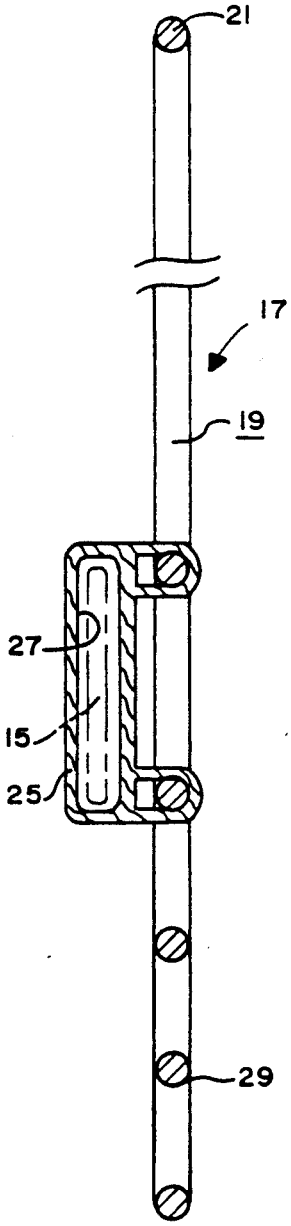
FIG. 5 is a sectional view of the first anchor means of the apparatus of the present invention substantially as taken on line 5—5 of FIG. 1 with a waist belt shown in broken lines.

The apparatus 11 includes a first anchor means 17 for being attached to the waist belt 15. The first anchor means 17 preferably includes a male member 19 for extending generally upwardly when the first anchor means 17 is attached to the waist belt 15. The male member 19 preferably has a substantially pointed outer end 21. At least the outer end 21 of the male member 19 has a cavity 23 therein. The first anchor means 17 preferably includes a belt loop means 25 for receiving the waist belt 15. The belt loop means 25 preferably has a slot 27 through which the waist belt 15 can be extended in a manner as will now be apparent to those skilled in the art. The first anchor means 17 preferably includes a pressure distribution means 29 for resting against a relatively large area of the performer's body as clearly shown in FIG. 9 to spread out and distribute any force transmitted from the guitar 13 to the performer's body through the apparatus 11. The specific construction, size and shape of the first anchor means 17 may vary. Preferably, the male member 19 and pressure distribution means 29 are constructed as an integral unit out of metal rods or the like bent or otherwise formed as a open skeletal frame in the general shape as shown in the drawings. The belt loop means 25 is preferably constructed out of a strong, flexible fabric sewn or otherwise securely attached to the male member 19 as clearly shown in FIG. 5 and as will now be apparent to those skilled in the art.

The guitar 13 has a back side 31 and a guitar strap 33 is preferably attached to the guitar 13 and positioned so as to extend across at least a portion of the back side 31 thereof. More specifically, the guitar strap 33 includes first and second ends 35, 37 for being attached to opposite ends of the body of the guitar 13 by first and second attachment means 39, 41 as clearly shown in FIGS. 8 and 10 and as will be apparent to those skilled in the art. The guitar strap 33 preferably includes typical adjustment means 43 for adjusting the length thereof. The length of the guitar strap 33 is preferably adjusted so that it is tightly stretched between the first and second attachment means 39, 41 and so that it is substantially stationary. The specific construction and operation of the guitar 13, guitar strap 33, attachment means 39, 41, and adjustment means 43 may vary as will be apparent to those skilled in the art.

The apparatus 11 includes a second anchor means 45 for being attached to the guitar 13 and for securing the first anchor means 17 to the guitar 13. More specifically, the second anchor means 45 is preferably adapted to removably secure the first anchor means 17 to the guitar strap 33 to thereby removably secure the guitar 13 to the waist belt 15. The second anchor means 45 preferably includes a female member 47 for receiving the male member 19 of the first anchor means 17 and preferably includes a guitar strap loop means 49 for receiving the guitar strap 33. The guitar strap loop means 49 preferably has a slot 51 through which the guitar strap 33 can be extended in a manner as will now be apparent to those skilled in the art. The guitar strap loop means 49 is preferably constructed out of a strong, flexible fabric as will now be apparent to those skilled in the art. The female member 47 preferably includes a first anchor loop means 53 for receiving the male member 19 of the first anchor means 17. The first anchor loop means 53 preferably has a slot 55 through which the outer end 21 of the male member 19 can be extended in a manner as will now be apparent to those skilled in the art. The first anchor loop means 53 may consist of a metal U-shaped member securely attached to the guitar strap loop means 49 in any manner now apparent to those skilled in the art.

The apparatus 11 preferably includes stop means 57 for controlling the depth of insertion of the male member 19 of the first anchor means 17 into the female member 47 of the second anchor means 45. The stop means 57 preferably consists of typical rubber 0-ring 59 sized so as to tightly fit over the outer end 21 of the male member 19 and to prevent passage through the slot 55 as will now be apparent to those skilled in the art. Thus, the performer P can merely slide the 0-ring 59 up or down on the male member 19 to control the depth of insertion of the male member 19 into the female member 47 and thereby control the height at which the guitar 13 is held with respect to the waist belt 15 as will now be apparent to those skilled in the art.

Figure 1:
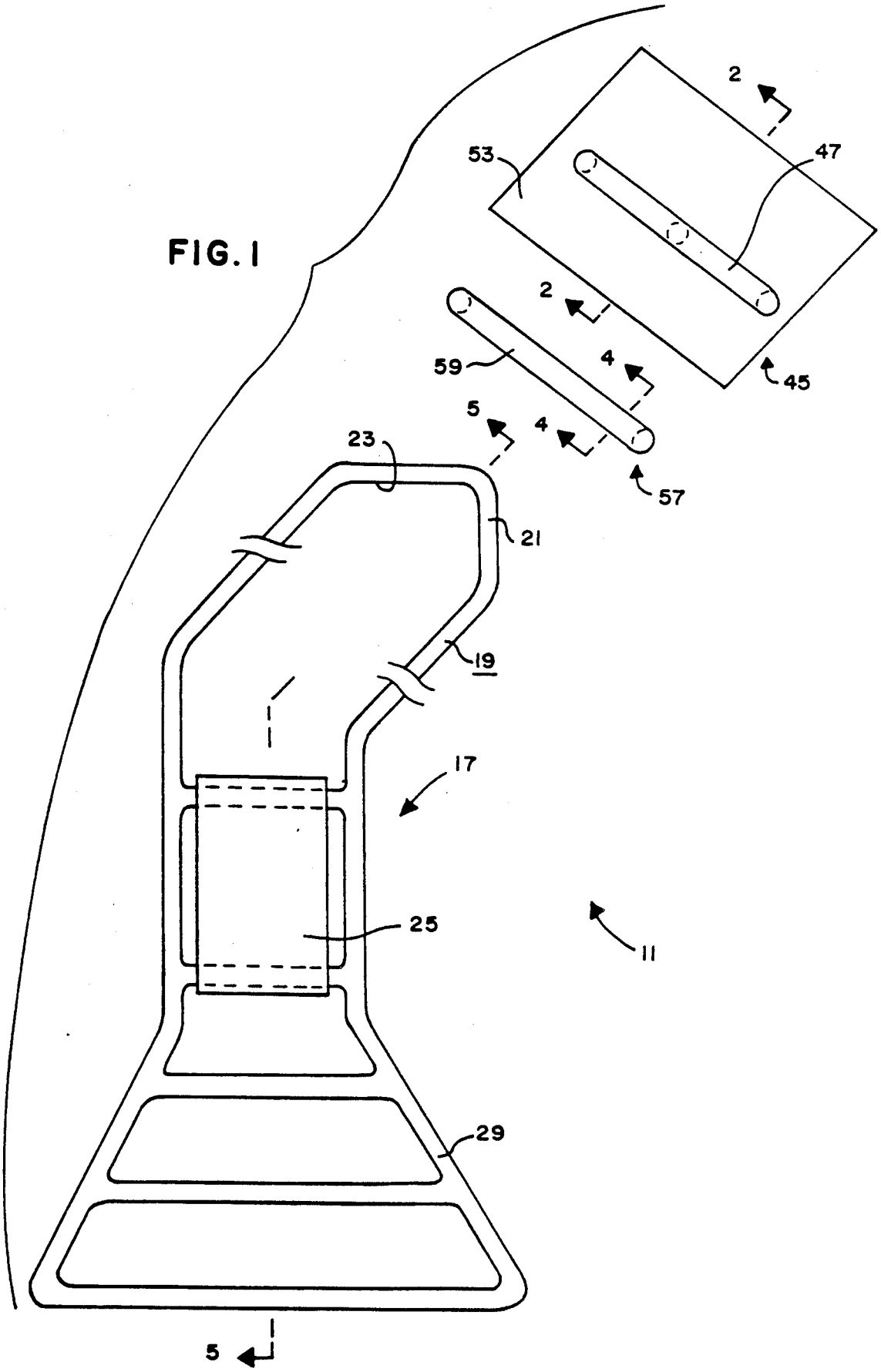
FIG. 1 is an exploded view of the apparatus of the present invention.
Figure 2:
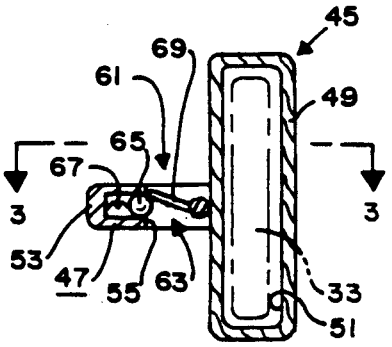
FIG. 2 is a sectional view of the second anchor means of the apparatus of the present invention substantially as taken on line 2—2 of FIG. 1 with a guitar strap shown in broken lines.
Figure 3:
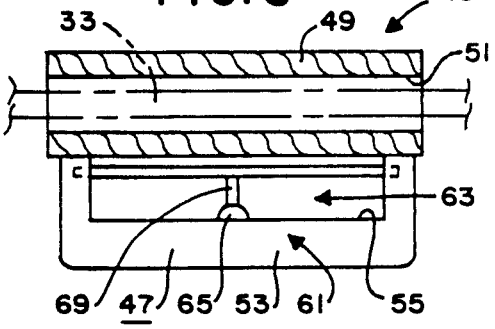
FIG. 3 is a sectional view substantially as taken on line 3—3 of FIG. 2.
Figure 4:
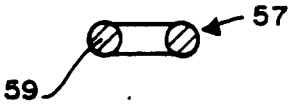
FIG. 4 is a sectional view of a stop means of the apparatus of the present invention substantially as taken on line 4—4 of FIG. 1.

The apparatus 11 includes securing means 61 for removably securing the first and second anchor means 17, 45 to one another. The securing means 61 preferably includes projection means 63 for at least partially blocking the slot 55 of the first anchor loop means 53 and for extending into the cavity 23 in the outer end 21 of the male member 19 when the male member 19 is positioned within the female member 47 to hinder removal of the male member 19 from the female member 47. The projection means 63 preferably includes a ball member 65 movably attached to the first anchor loop member 53 of the second anchor means 45 for moving between an extended position in which it at least partially blocks the slot 55 to hinder removal of the male member 19 from the slot 55 and a contracted position as the male member 19 is being inserted into or extracted from the female member 47. The projection means 63 preferably includes a spring member 67 for normally urging the ball member 65 to the extended position. The securing means 61 preferably includes a tongue member 69 for coacting with the ball member 65 to selectively block the slot 55 and to hinder removal of the male member 19 from the slot 55. The tongue member 69 is preferably hinged at one end to the second anchor means 45 on the opposite side of the slot 55 from the ball member 65 and sized so as to extend across the slot 55 and engage the ball member 65 when the ball member 65 is in the extended position as clearly shown in, for example, FIG. 2. A spring or the like (not shown) may be provided for normally urging the tongue member 69 against the ball member 65 as will now be apparent to those skilled in the art.

Figure 6:
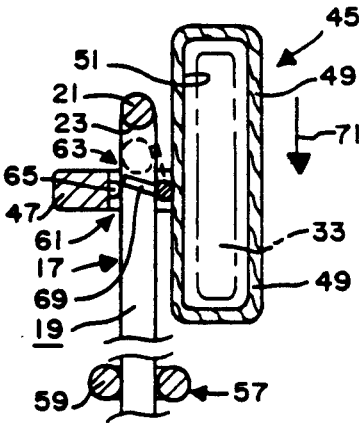
FIG. 6 is a sectional view showing the first and second anchor means locked to one another.
Figure 7:
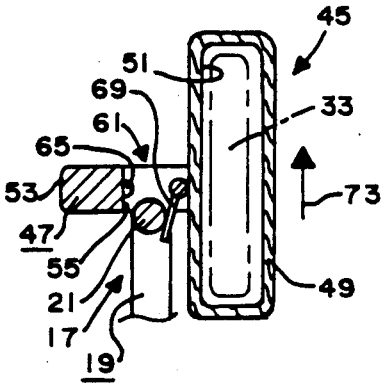
FIG. 7 is a sectional view similar to FIG. 6 but with the first anchor means being removed from the second anchor means.

The operation and use of the apparatus 11 is quite simple. The first anchor means 17 is attached to the waist belt 15 by merely inserting the end of the waist belt 15 through the slot 27 of the belt loop means 25. The first anchor means 17 can then be positioned at any desired location about the performer's waist (e.g., just to the front of the performer's hip) as will now be apparent to those skilled in the art. The second anchor means 45 is attached to the guitar strap 33 by merely inserting one end of the guitar strap 33 through the slot 51 of the guitar strap loop means 49. With the waist belt 15 secured about the performer's waist and with the guitar strap 33 tightly secured across the back side 31 of the guitar 13, the performer P can merely slide the guitar 13 downward as indicated by the arrow 71 in FIG. 6 so that the outer end 21 of the male member 19 will be received by the slot 55 of the female member 47. As the outer end 21 of the male member 19 is received by the slot 55, it will cause the tongue member 69 to move upward away from the ball member 65 as indicated by broken lines in FIG. 6. The O-ring 59 will control the depth of insertion of the male member 19 into the slot 55. Once the outer end 21 of the male member 19 has been inserted through the first anchor loop means 53, the tongue member 69 will pivot against the ball member 65 as shown in solid lines in FIG. 6 to prevent accidental disengagement of the first and second anchor means 17, 45 as will now be apparent to those skilled in the art. To disengage the first and second anchor means 17, 45, the guitar 13 is merely moved upward as indicated by the arrow 73 in FIG. 7. As the outer end 21 of the male member 19 is removed from the slot 55, the tongue member 69 will be pulled downward past the ball member 65 as shown in FIG. 7. It will be understood that the tongue member 69 will cause the ball member 65 to move to the contracted position as it is pulled downward by the outer end 21 of the male member 19.

As thus constructed and used, the apparatus 11 allows the performer P to secure the musical instrument (e.g., the guitar 13) to the performer's waist belt 15 in the most comfortable position. The securing means 61 will prevent the guitar 13 from accidentally being pulled off the first anchor means 17 while allowing a good snug upward pull on the guitar 13 to release the guitar 13 from the first anchor means 17 as will now be apparent to those skilled in the art. The stop means 57 allows the playing height of the guitar 13 to be varied.

Although the present invention has been described and illustrated with respect to a preferred embodiment and a preferred use therefor, it is not to be so limited since modifications and changes can be made therein which are within the full intended scope of the invention.

I claim:

1. An apparatus for securing a musical instrument to a waist belt that is attached relative to a performer's waist, said apparatus comprising:

(a) first anchor means for being attached to said waist belt; said first anchor means including a male member for extending generally upwardly when said first anchor means is attached to said waist belt;

(b) second anchor means for being attached to said musical instrument; said second anchor means including a female member for receiving said male member of said first anchor means; and (c) securing means for removably securing said first anchor means to said second anchor means.

2. The apparatus of claim 1 in which said musical instrument has a back side, in which is included a musical instrument strap substantially stationarily attached to said musical instrument and extending across at least a portion of said back side of said musical instrument; and in which said second anchor means includes musical instrument strap loop means for receiving said musical instrument strap.

3. The apparatus of claim 2 in which said first anchor means includes belt loop means for receiving said waist belt.

4. The apparatus of claim 3 in which said first anchor means includes pressure distribution means for resting against a large area of said performer's body.

5. The apparatus of claim 2 in which is included stop means for controlling the depth of insertion of said male member of said first anchor means into said female member of said second anchor means.

6. The apparatus of claim 5 in which said male member of said first anchor means has a substantially pointed first end for being easily received by said female member of said second anchor means.

7. The apparatus of claim 6 in which said female means of said second anchor means includes a first anchor loop means for receiving said male member of said first anchor means.

8. The apparatus of claim 7 in which said securing means includes projection means attached to said first anchor loop member of said second anchor means for extending at least partially across the interior of said first anchor loop member and for removably securing said male member of said first anchor means within the interior of said first anchor loop member of said second anchor means.

9. The apparatus of claim 8 in which at least said first end of said male member of said first anchor means has a cavity for receiving at least a portion of said projection means of said securing means when said male member is received by said female member.

10. The apparatus of claim 9 in which said projection means includes a ball member attached to said first anchor loop member of said second anchor means for moving between an extended position when said male member is positioned within said female member and a contracted position as said male member is being inserted into or extracted from said female member.

11. The apparatus of claim 10 in which said securing means includes a tongue member for coacting with said ball member to selectively block said female member and to hinder removal of said male member from said female member.

* * * * *